US005154782A

United States Patent [19]

Shaw et al.

[11] Patent Number: 5,154,782

[45] Date of Patent: Oct. 13, 1992

[54] OBSCURING AND NONTOXIC SMOKE COMPOSITIONS

[75] Inventors: Graham C. Shaw, Garland; Daniel B. Nielson, Brigham City; Leon L. Jones, Ogden; Stanley G. Summers, Bothwell, all of Utah

[73] Assignee: Thiokol Corporation, Ogden, Utah

[21] Appl. No.: 745,501

[22] Filed: Aug. 15, 1991

[51] Int. Cl.[5] ..... C06B 45/10

[52] U.S. Cl. ..... 149/19.5; 149/19.6; 149/19.8; 149/42; 149/85; 149/117; 252/305

[58] Field of Search ..... 252/305; 149/117, 19.5, 149/19.6, 19.8, 42, 85

[56] References Cited

U.S. PATENT DOCUMENTS

| | | | |
|---|---|---|---|
| H227 | 3/1987 | Tracey et al. | 149/84 |
| H233 | 3/1987 | Tracy | 149/83 |
| 2,995,526 | 8/1961 | De Ment | 252/305 |
| 3,418,184 | 12/1968 | Vetter | 149/19 |
| 3,793,099 | 2/1974 | Duerksen et al. | 149/19 |
| 3,881,420 | 5/1975 | Smith et al. | 102/90 |
| 3,914,142 | 10/1975 | Sayles | 149/19.8 |
| 4,032,374 | 6/1977 | Douda et al. | 149/19.8 |
| 4,938,813 | 7/1990 | Eisele et al. | 149/19.2 |

*Primary Examiner*—Richard D. Lovering
*Assistant Examiner*—N. Bhat
*Attorney, Agent, or Firm*—Madson & Metcalf

[57] ABSTRACT

A composition which is capable of producing an obscuring white smoke is disclosed which employs a dicarboxylic acid as the primary smoke producing agent. It is found that by using a dicarboxylic acid smoke producing agent, a generally non-toxic and non-corrosive smoke is achieved. Also included within the composition are a binder, a fuel or coolant, and an oxidizer. The binder may be any one of a number of binders such as nitrocellulose or a polymer binder. A low energy fuel is preferred in order to minimize heat and flame produced. Such fuels may include, for example, starch, dextrose, lactose, sucrose, or sulphur. The presently preferred oxidizer is $KCLO_3$. Other substances may also be added to the composition. For example, sodium bicarbonate may be added to act as a buffer for the $KCLO_3$ and as a further coolant. In some cases it may also be desirable to add aluminum for purposes of producing more uniform burning and increased thermal conductivity through out the composition.

23 Claims, No Drawings

OBSCURING AND NONTOXIC SMOKE COMPOSITIONS

BACKGROUND

1. The Field of the Invention

The present invention is related to pyrotechnic smoke producing compositions. More particularly, the present invention is related to generally non-toxic and non-corrosive smoke producing compositions which incorporate, as a smoke producing agent, at least one aliphatic dicarboxylic acid.

2. Technical Background

In various contexts it is desirable to have the capability of producing smoke for a number of different types of use. For example, the ability to produce smoke at a particular location may provide the basis for a remote signaling system. Such a system may have application in search and rescue operations and in military exercises. Smoke of a particular color and density may also be desirable for training purposes. For example, in order to train fire fighters it would be advantageous to simulate specific types of fire conditions. For individuals working in a fire-prone environment, such as on an aircraft or ship, it would also be desirable to have the capability of simulating fire in order to provide a realistic fire drill.

Smoke can be used as a marker for various purposes. A smoke marker can be seen from substantial distances, either from the ground for from the air. Accordingly, a smoke marker would be useful in military operations, search and rescue, certain types of industrial projects, or in any other situation in which it is important to find and mark a particular location.

In the military context, the need for smoke producing devices and compositions is well appreciated. As mentioned above, smoke can be used as a marker. Smoke may be used to mark a particular target, or it may be used as a marker in determining the position of specific personnel and equipment.

Smoke may also be used to obscure vision. A shield of smoke may be very helpful in conducting military operations in order to prevent adverse forces from obtaining a clear view of the operations. For example, it may be desirable to use a vision obscuring smoke in order to move troops and equipment under at least partial cover.

Various types of smoke producing compositions and devices are presently known, however, most such smoke producing compositions have severe limitations. One of the limitations is that of toxicity. Many smoke producing compositions incorporate materials which are severely toxic or are irritants when subjected to the heat necessary to produce smoke. The problem of toxicity and irritation to people is clearly a limitation in several respects. Not only does it increase the potential for injury, but it may dictate the use of additional specialized equipment, such a respiratory protection. This type of equipment is expensive, and in the situations such as training exercises, may detract from the ability to simulate actual conditions.

A related problem is the effect of smoke producing compositions on equipment and supplies. In addition to being toxic and irritating to people, conventional smoke producing compositions are corrosive and damaging to both mechanical and electronic equipment. It will be appreciated that this is a major disadvantage in the operational context in which a smoke producer is typically employed. Smoke producers are usually employed in field operations which involve the use of precision electronic and mechanical equipment, that may be damaged by the corrosive exhaust of such smoke producing agents. Accordingly, the use of corrosive and damaging chemical compositions is a severe limitation.

One example of a widely known smoke producing composition employs a reaction between hexachloroethane and zinc to produce zinc chloride. However, the reaction products from this reaction are very toxic, limiting the usefulness and applicability of the composition. Another common smoke producing composition employs phosphorous, and phosphorous compounds. These chemicals, however, are known to be extreme irritants when reacted to produce smoke. In addition, phosphorous reactions typically produce intense heat which is a further hazard and limitation of this type of material.

Another class of smoke producing compounds comprise aromatic organic materials. Various types of aromatics are known to produce smoke. Indeed, certain aromatics produce smoke of intense color and have been used widely in military applications. The problem with aromatic compounds, however, it that they are also generally toxics and irritants. The reaction products of aromatic compounds are also corrosive and toxic.

In summary, there is a need for effective smoke producing compositions. This need exists in military and civilian operations. However, many smoke producing compositions presently used are difficult to handle. Many such compositions are toxic and irritating, and require special precautions during use. Many such compositions are corrosive and damaging to both electronic and mechanical equipment. Finally, some such compositions produce an excess of heat and flame, again limiting there usefulness and requiring that additional safety measures be taken. For these reasons, conventional smoke producing compositions are found to be inadequate.

As a result, it would be a significant advancement in the art to provide a smoke producing composition which was capable of overcoming the limitations in the existing art. In particular, it would be an advancement in the art to provide a smoke producing composition which was generally non-toxic and non-corrosive. It would be a related advantage in the art to provide such a composition which did not incorporate toxic or irritating materials such as zinc, phosphorous, and aromatic organic compounds. It would be another advancement in the art to provide smoke producing compositions which were simple to manufacture and use, but were still effective smoke producers.

Such compositions are disclosed and claimed herein.

BRIEF SUMMARY AND OBJECTS OF THE INVENTION

The present invention is related to pyrotechnic smoke producing compositions which are generally non-toxic and non-corrosive. In its preferred embodiments, the present invention discloses the use of smoke producing compositions which incorporate at least one aliphatic dicarboxylic acid as a smoke producing agent.

The use of aliphatic dicarboxylic acids as smoke producing agents overcomes many of the severe problems encountered in the existing art. In particular, the present invention provides compositions which are generally non-toxic, non-corrosive, and which can be formulated to burn at lower temperatures and with a lower energy output.

It is generally preferred that the smoke producing agents of the present invention comprise aliphatic dicarboxylic acids having from 6 to 12 total carbon atoms; however, other aliphatic dicarboxylic acids may also produce acceptable results. In general, it is also preferred that the dicarboxylic acids be saturated. Thus, formulation incorporating dicarboxylic acids such as adipic acid, pimelic acid, suberic acid, and sebacic acid fall within the scope of the present invention.

The compositions of the present invention also incorporate at least one binder for providing the desired consistency. Indeed, the compositions of the present invention may be formulated such that they are mix castable and do not require press casting. This is a significant safety advantage.

Numerous binders are known and used in the art and fall within the scope of the present invention. However, specific binders which have been found to have acceptable characteristics include aliphatic polyester ethers, and poly ether-sulfide polymers. In certain applications nitrocellulose is specifically desirable in that it results in a decreased solid residue within the burned grain.

Binders of these types, in addition to providing desirable binding characteristics, produce a small energy output upon combustion. This is important in avoiding very high energy outputs, high temperatures, and flames which render smoke producing compositions dangerous and difficult to handle.

The composition of the present invention also includes one or more oxidizer compounds. It is found that potassium chlorate ($KClO_3$): is an efficient oxidizer and producers good results when coupled with the dicarboxylic acid smoke producing species.

In certain embodiments the composition of the present invention includes an additional fuel. As with the binder, the fuel is preferably a relatively low energy fuel, and may in fact act as a coolant. It is also preferred that the fuel produce gaseous species which are capable of carrying the smoke producing agent into the atmosphere. Some fuels which are found to be acceptable include starch, dextrose, polyhydroxylic compounds such as lactose, sucrose, and sulfur. It will be appreciated that in some of the preferred embodiments, the binder compositions are capable of serving the function of the low energy fuel so that no additional fuel need be added.

Certain other materials may also be added to produce specific desired results. One desired material is sodium bicarbonate. Sodium bicarbonate acts as a buffer which prevents auto catalytic decomposition of the $KClO_3$. Sodium bicarbonate also functions as a coolant when the composition is combusted. Another additive is aluminum. In some cases, atomized aluminum may provide additional thermal conductivity within the composition. This results in more uniform heat transfer and ignition of the fuel.

In operation, the compositions of the present invention are capable of producing an obscuring white smoke output of the type needed in the applications discussed above. At the same time, the smoke is generally non-toxic and non-corrosive. Therefore, the compositions of the present invention overcome many of the limitations of the existing art. In addition, the compositions of the present invention are capable of being easily placed into a small unit for immediate usage to form signal or obscuring clouds.

Accordingly, it is a primary object of the present invention to provide smoke producing compositions which are capable of overcoming certain of the limitations of the existing art.

It is an object of the present invention to provide a smoke producing composition which is generally non-toxic and non-corrosive.

It is a related object of the present invention to provide a composition which does not incorporate materials which produce a toxic or corrosive output such as zinc, phosphorous, or aromatic organic compounds.

It is another object of the present invention to provide such a composition which is simple to manufacture and use, but which is still an effective smoke producer.

These and other objects and advantages of the invention will become apparent upon reading the following detailed description and appended claims.

DETAILED DESCRIPTION OF THE PREFERRED EMBODIMENTS

As mentioned above, the present invention comprises compositions for producing a large white smoke output upon combustion. The present invention also provides a composition which produces such an output with a relatively low energy output, producing smoke which is also generally non-toxic and non-corrosive.

The present invention employs at least one aliphatic dicarboxylic acid as the smoke producing component. It is presently preferred that the dicarboxylic acid be a saturated chain having from about 6 to about 12 total carbon atoms; however, other aliphatic dicarboxylic acids also fall within the scope of the present invention. Some preferred dicarboxylic acids include adipic acid, pimelic acid, suberic acid, azelaic acid, and sebacic acid. In a series of small scale tests on 10 to 100 gram samples it was found that adipic, suberic, azelaic, and sebacic acid all produced white smoke outputs of desirable density and composition. In larger scale tests, it was found that sebacic acid produced particularly dense smoke clouds.

The percentage of dicarboxylic acid in the overall composition may vary greatly. Compositions in which dicarboxylic acid makes up from about 25% to about 75% , by weight, of the overall composition are presently preferred. From data presently accumulated, dicarboxylic acid in the range of from about 37% to about 65% is expected to produce particularly beneficial results. With dicarboxylic acid concentration outside of this preferred range, smoke outputs and smoke density is generally found to decrease somewhat. However, such compositions may be desirable for specific applications and fall within the scope of the present invention.

As mentioned above, the compositions of the present invention also incorporate at least one binder. Many acceptable binders are known and available in the art. Some acceptable binders include epoxy and polyester binders such as a product manufactured by WITCO known as WITCO F17-80. Polysulfide polymers such as LP-33 and LP-32 manufactured by Morton Company are also found to be acceptable. Generally, these binders are desirable because of their relatively low energy output upon combustion. Nitrocellulose is also found to be a good binder in the compositions of the present invention.

It is presently preferred that the binder comprises from about 3% to approximately 30% of the composition. In the case of higher energy binders, such as epoxies and polyesters, it may be desirable to maintain the percentage binder in the range of about 15% or less in order to maintain desirable low energy outputs. Use of more of these binders results in a greater heat output than may be desirable. This also results in a decrease in the quantity and quality of the smoke output.

Binders such as LP-33 and nitrocellulose do not result in these higher heat outputs and may be used in greater percentages. Indeed, when using these binders, the binder may act in place of the fuel. This allows the amount of smoke producing agent it be increased and for further flexibility in formulation of smoke producing compositions for specific uses.

The composition of the present invention also includes one or more oxidizer compounds such as potassium chlorate ($KClO_3$). The percentage of oxidizer may vary widely as desired. Generally, it is preferred that the oxidizer comprise from about 20% to about 40% of the total composition. Compositions having oxidizer in range of from approximately 25% to approximately 35% are found to produce good results and are presently preferred.

The composition of the present invention may also include a fuel, which fuel may be partially or totally replaced by the binder as mention above. For the reasons enumerated above, the fuel is preferably a relatively low energy fuel, which may in fact act as a coolant. Fuel in the amount of from approximately 0% to approximately to approximately 25% is generally preferred in the compositions of the present invention.

Numerous different types of materials are acceptable as a fuel/coolant for the compositions of the present invention. Some of the acceptable materials include starch, dextrose, polyhydroxylic compounds such as lactose, sucrose, sulfur, and the binder compositions identified above.

Other materials, such as sodium bicarbonate and aluminum, may also be added to produce particular desired effects Sodium bicarbonate generally acts as a buffer and coolant. Sodium bicarbonate and/or magnesium carbonate is preferably added to the composition in the range of from about 1% to about 20%. In some compositions it is found that atomized aluminum may provide additional thermal conductivity and resulting uniform heat transfer and ignition of the fuel. Aluminum in the range of from about 2% to about 5% is presently preferred.

In operation, the heat produced by the controlled combustion of the low energy fuel and the oxidizer drives the production of smoke by the dicarboxylic acid smoke producer. In general operation, the heat produced sublimes the obscuring smoke agent from a container to produce a dense white smoke cloud. Because of the materials used in the compositions, the smoke cloud is not corrosive, toxic, or an irritant. This is a substantial improvement over most conventional smoke producing compositions.

EXAMPLES

The following examples illustrate various aspects of the invention, but it will be obvious that various changes and modifications may be made therein without departing from the scope of the invention.

EXAMPLE 1

A composition capable of producing an obscuring smoke, within the scope of the present invention, was formulated from the following materials, combined in the indicated percentages (by weight):

| Materials | Percentage |
|---|---|
| Sebacic acid | 40% |
| Nitrocellulose | 10 |
| Lactose | 10 |
| $KCLO_3$ | 35 |
| Aluminum | 5 |

When ignited, this composition was found to produce a cloud of obscuring, non-toxic, and non-corrosive white smoke.

EXAMPLE 2

A composition capable of producing an obscuring smoke, within the scope of the present invention, was formulated from the following materials, combined in the indicated percentages:

| Materials | Percentage |
|---|---|
| Adipic acid | 50% |
| Nitrocellulose | 15 |
| $KCLO_3$ | 30 |
| Aluminum | 5 |

When ignited, this composition was found to produce a cloud of obscuring, non-toxic, and non-corrosive white smoke.

EXAMPLE 3

A composition capable of producing an obscuring smoke, within the scope of the present invention, was formulated from the following materials, combined in the indicated percentages:

| Materials | Percentage |
|---|---|
| Sebacic acid | 45% |
| LP-33 | 8 |
| Lactose | 15 |
| $KCLO_3$ | 30 |
| Aluminum | 2 |

When ignited, this composition was found to produce a cloud of obscuring, non-toxic, and non-corrosive white smoke.

EXAMPLE 4

A composition capable of producing an obscuring smoke, within the scope of the present invention, was formulated from the following materials, combined in the indicated percentages:

| Materials | Percentage |
|---|---|
| Adipic acid | 37% |
| Epoxy | 8 |
| Lactose | 20 |
| $KCLO_3$ | 30 |
| Sodium Bicarbonate | 5 |

When ignited, this composition was found to produce a cloud of obscuring, non-toxic, and non-corrosive white smoke.

EXAMPLE 5

A composition capable of producing an obscuring smoke, within the scope of the present invention was formulated from the following materials, combined in the indicated percentages:

| Materials | Percentage |
|---|---|
| Sebacic acid | 37% |
| WITCO F1780 | 8 |
| Lactose | 20 |
| $KClO_3$ | 30 |
| Magnesium Carbonate | 5 |

When ignited, this composition was found to produce a cloud of obscuring, non-toxic, and non-corrosive white smoke.

EXAMPLE 6

A composition capable of producing an obscuring smoke, within the scope of the present invention, was formulated from the following materials, combined in the indicated percentages:

| Materials | Percentage |
|---|---|
| Sebacic acid | 42% |
| LP-33 | 8 |
| Lactose | 15 |
| $KClO_3$ | 30 |
| Sodium Bicarbonate | 5 |

When ignited, this composition was found to produce a cloud of obscuring, non-toxic, and non-corrosive white smoke.

EXAMPLE 7

A composition capable of producing an obscuring smoke, within the scope of the present invention, was formulated from the following materials, combined in the indicated percentages:

| Materials | Percentage |
|---|---|
| Sebacic acid | 45% |
| Nitrocellulose | 20 |
| $KClO_3$ | 30 |
| Sodium Bicarbonate | 5 |

When ignited, this composition was found to produce a cloud of obscuring, non-toxic, and non-corrosive white smoke.

EXAMPLE 8

A composition within the scope of the present invention is formulated from the following materials, combined in the indicated percentages:

| Materials | Percentage |
|---|---|
| Pimelic acid | 25% |
| WITCO F1780 | 25 |
| starch | 20 |
| $KClO_3$ | 25 |
| Sodium Bicarbonate | 5 |

When ignited, this composition is found to produce a cloud of obscuring, non-toxic, and non-corrosive white smoke.

EXAMPLE 9

A composition within the scope of the present invention is formulated from the following materials, combined in the indicated percentages:

| Materials | Percentage |
|---|---|
| Suberic acid | 60% |
| LP-33 | 3 |
| sulphur | 15 |
| $KClO_3$ | 20 |
| Sodium Bicarbonate | 2 |

When ignited, this composition was found to produce a cloud of obscuring, non-toxic, and non-corrosive white smoke.

EXAMPLE 10

A composition within the scope of the present invention is formulated from the following materials, combined in the indicated percentages:

| Materials | Percentage |
|---|---|
| Azelaic Acid | 60% |
| Nitrocellulose | 5 |
| sucrose | 5 |
| $KClO_3$ | 25 |
| Sodium Bicarbonate | 5 |

When ignited, this composition is found to produce a cloud of obscuring, non-toxic, and non-corrosive white smoke.

SUMMARY

In summary, the present invention meets each of the objectives identified above. The compositions of the present invention are capable of providing an obscuring white smoke which has characteristics which are preferable over those produced by most known smoke producing compositions. The smoke produced is generally non-toxic and non-corrosive. As a result, it can be readily used without the need for specialized respiratory equipment and without the fear of damage to sensitive mechanical and electrical equipment. The composition is capable of producing an obscuring smoke cloud while avoiding the use of toxic and corrosive materials such as zinc, phosphorous, and aromatic organic compounds. The composition can be formulated such that it is capable of being mix castable. As a result, the composition is simple to manufacture and use, and is still an effective smoke producer.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A smoke producing composition which is generally non-toxic and non-corrosive comprising:

at least one smoke producing agent selected from the group consisting of aliphatic dicarboxylic acids;

at least one binder; and at least one oxidizer.

2. A smoke producing composition as defined in claim 1 further comprising at least one fuel or coolant.

3. A smoke producing composition as defined in claim 2 wherein said fuel is selected from the group consisting of starch, dextrose, sucrose, sulfur and lactose.

4. A smoke producing composition as defined in claim 1 wherein said smoke producing agent comprises from about 37 percent to about 65 percent of the total composition.

5. A smoke producing composition as defined in claim 1 wherein said oxidizer comprises $KCLO_3$.

6. A smoke producing composition as defined in claim 1 wherein said at least one binder comprises nitrocellulose.

7. A smoke producing composition as defined in claim 1 wherein said at least one binder comprises a polyester-ether.

8. A smoke producing composition as defined in claim 1 wherein said at least one binder comprises a poly ether-sulfide polymer.

9. A smoke producing composition as defined in claim 1 further comprising sodium bicarbonate.

10. A smoke producing composition as defined in claim 1 wherein said at least one aliphatic dicarboxylic acid is saturated.

11. A smoke producing composition as defined in claim 10 wherein said at least one aliphatic dicarboxylic acid comprises from about 6 to about 12 total carbon atoms.

12. A smoke producing composition as defined in claim 1 further comprising aluminum.

13. A smoke producing composition as defined in claim 1, wherein said aliphatic dicarboxylic acid is selected from the group consisting of adipic acid, pimelic acid, suberic acid, azealic acid and sebacic acid.

14. A smoke producing composition comprising:

from about 37% to about 65% of at least one aliphatic dicarboxylic acid;

from about 3% to about 30% of at least one binder; and from about 25% to about 35% of at least one oxidizer.

15. A smoke producing composition as defined in claim 14 further comprising from about 10% to about 30% low energy fuel.

16. A smoke producing composition as defined in claim 14 further comprising from about 2% to about 7% of at least one coolant and buffer compound.

17. A smoke producing composition as defined in claim 16 wherein said coolant and buffer compound comprises sodium bicarbonate.

18. A smoke producing composition as defined in claim 14 wherein said at least one aliphatic dicarboxylic acid comprises from about 6 to about 12 total carbon atoms.

19. A smoke producing composition as defined in claim 14 wherein said at least one aliphatic dicarboxylic acid comprises a straight chain molecule.

20. A smoke producing composition as defined in claim 14 wherein said oxidizer is $KCLO_3$.

21. A smoke producing composition as defined in claim 14 wherein said binder is nitrocellulose.

22. A smoke producing composition as defined in claim 14 wherein said bind is a polymeric binder.

23. A smoke producing composition comprising:

from about 37% to about 65% of at least one aliphatic dicarboxylic acid having 6 to 12 total carbon atoms;

from about 3% to about 30% of at least one binder;

from about 25% to about 35% of KCLO3;

from about 10% to about 30% low energy fuel; and from about 2% to about 7% sodium bicarbonate.

* * * * *

UNITED STATES PATENT AND TRADEMARK OFFICE

CERTIFICATE OF CORRECTION

PATENT NO. : 5,154,782

DATED : October 13, 1992

INVENTOR(S) : Graham C. Shaw; Daniel B. Nielson; Leon L. Jones; and Stanley G. Summers It is certified that error appears in the above-identified patent and that said Letters Patent is hereby corrected as shown below:

Column 1, line 29 "for" should be --or--
Column 1, line 56 "a" should be --as--
Column 2, line 36 "there" should be --their--
Column 3, line 33 ":" should be --,--
Column 3, line 34 "producers" should be --produces--
Column 5, line 10 "it" should be --to--
Column 5, line 24 "mention" should be --mentioned--
Column 5, line 28 "to approximately to approximately" should be --to approximately--
Column 5, line 38 "effects" should be --effects.--

Column 10, line 28 "bind" should be --binder--

Signed and Sealed this

Fifteenth Day of March, 1994

Bruce Lehman

*Attest:*

BRUCE LEHMAN

*Attesting Officer*

*Commissioner of Patents and Trademarks*